US010231585B2

(12) United States Patent
Gottschall

(10) Patent No.: US 10,231,585 B2
(45) Date of Patent: Mar. 19, 2019

(54) LATCH FOR VACUUM CLEANER

(71) Applicant: SHOP VAC CORPORATION, Williamsport, PA (US)

(72) Inventor: Jason Gottschall, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 302 days.

(21) Appl. No.: 15/086,351

(22) Filed: Mar. 31, 2016

(65) Prior Publication Data

US 2017/0280955 A1 Oct. 5, 2017

(51) Int. Cl.

| | |
|---|---|
| ***A47L 7/00*** | (2006.01) |
| ***A47L 5/36*** | (2006.01) |
| ***A47L 9/14*** | (2006.01) |
| ***A47L 9/00*** | (2006.01) |

(52) U.S. Cl.

CPC ..... *A47L 7/0019* (2013.01); *A47L 5/365* (2013.01); *A47L 9/00* (2013.01); *A47L 9/1409* (2013.01)

(58) Field of Classification Search

CPC ..... A47L 7/0019; A47L 9/00; A47L 5/365; A47L 9/1409; A47L 7/00

See application file for complete search history.

(56) References Cited

U.S. PATENT DOCUMENTS

| | | | |
|---|---|---|---|
| 5,611,107 | A | 3/1997 | Tomasiak et al. |
| 2015/0013100 | A1 | 1/2015 | Gottschall et al. |

OTHER PUBLICATIONS

European Search Report, European patent application No. 16180564.3, dated Sep. 20, 2017.

*Primary Examiner* — David Redding

(74) *Attorney, Agent, or Firm* — Marshall, Gerstein & Borun LLP

(57) ABSTRACT

A latch mechanism has two pieces that mount in an opening on the lid of a conventional vacuum cleaner. A stationary part is held in place by a hooked end that fits over a pivot edge on the lid, and by a retaining surface that engages a retaining edge on the lid. The other part is a pivoting latch that hooks onto the same pivot edge. In a latched position, an engagement surface on a deflectable arm fits over a latching surface on the stationary part, holding a moving part in position with a latching part beneath a bead on the tank. A tab surface can be used to force the deflectable arm to deflect over the latching part and simultaneously move the latching part clear of the bead.

8 Claims, 9 Drawing Sheets

LATCH FOR VACUUM CLEANER

CROSS-REFERENCE TO RELATED APPLICATIONS

Not applicable.

BACKGROUND OF THE INVENTION

The present invention relates generally to vacuum cleaners, and more particularly to latches used to secure the removable lid that is used on a wet/dry vacuum to close the open upper end of the tank. Many such vacuum cleaners have a pair of openings on the lid that accommodate prior art latches that are used to hold the lid on the tank.

The applicants have developed a new latch mechanism that is easy and inexpensive to manufacture and install on a conventional wet/dry vacuum cleaner, is visually intuitive for users to use, and holds a latched position more securely than some prior latches.

BRIEF SUMMARY

The new latch mechanism includes two new pieces that fit on a conventional vacuum cleaner. One of the pieces is a stationary part that is secured into an opening on the lid. The other piece is a latch that pivots about one of the same edges used to secure the stationary part, moving between a latched position and an unlatched position.

The stationary part has a hooked end that fits over a pivot edge on the lid. It also has a stationary retaining surface that engages a retaining edge on the lid. Together, the hooked end and the stationary retaining surface hold the stationary part in place on the lid.

The latch hooks onto the same pivot edge that is used for mounting the stationary part. In the latched position, a latching part of the latch inhibits the lid from being lifted from the tank. In the unlatched position, the latching part is moved to a different position and does not inhibit the lid being lifted from the tank. A user can use a tab surface on the latch to push the latch between the latched position and the unlatched position.

A latching surface on the stationary part is used to secure the latch in the latched position. An extended portion of the latching surface is spaced at a locking distance from the pivot axis. A latching portion of the latching surface is spaced closer to the pivot axis.

The latch has a deflectable arm that may be an integrally formed part of the latch. The deflectable arm has an engagement surface that fits over the latching surface on the stationary part when the latch is in the latched position. A central portion of the engagement surface may be positioned at the locking distance (or slightly farther) from the pivot axis, but the engagement surface also has a terminal portion that is positioned at a shorter distance from the pivot axis. This terminal portion is positioned on a terminal side of the deflectable arm, offset from the central portion of the engagement surface.

As the latch is moved to the latching position, the terminal side of the deflectable arm on the latch encounters the extended portion of the latching surface, and the terminal portion of the deflectable arm is deflected away from the pivot axis. After clearing the extended portion, the terminal portion subsequently deflects back, creating an interference fit between the terminal portion of the deflectable arm and the latching portion of the latching surface. This fit helps to firmly hold the latch in the latched position.

To facilitate deflection of the terminal portion of the deflectable arm over the latching surface, it is preferred that the deflectable arm be longer than it is thick, with its central portion being no more than four times thicker than the difference between the locking distance and the shorter distance from the pivot axis to the latching portion of the engagement surface. It is also preferred that the deflectable arm have a base end that is connected to a proximal end of a tab surface that is used to move the latch between positions.

BRIEF DESCRIPTION OF THE DRAWINGS

The invention may be better understood by referring to the accompanying drawings, in which.

DETAILED DESCRIPTION

Figure 1:
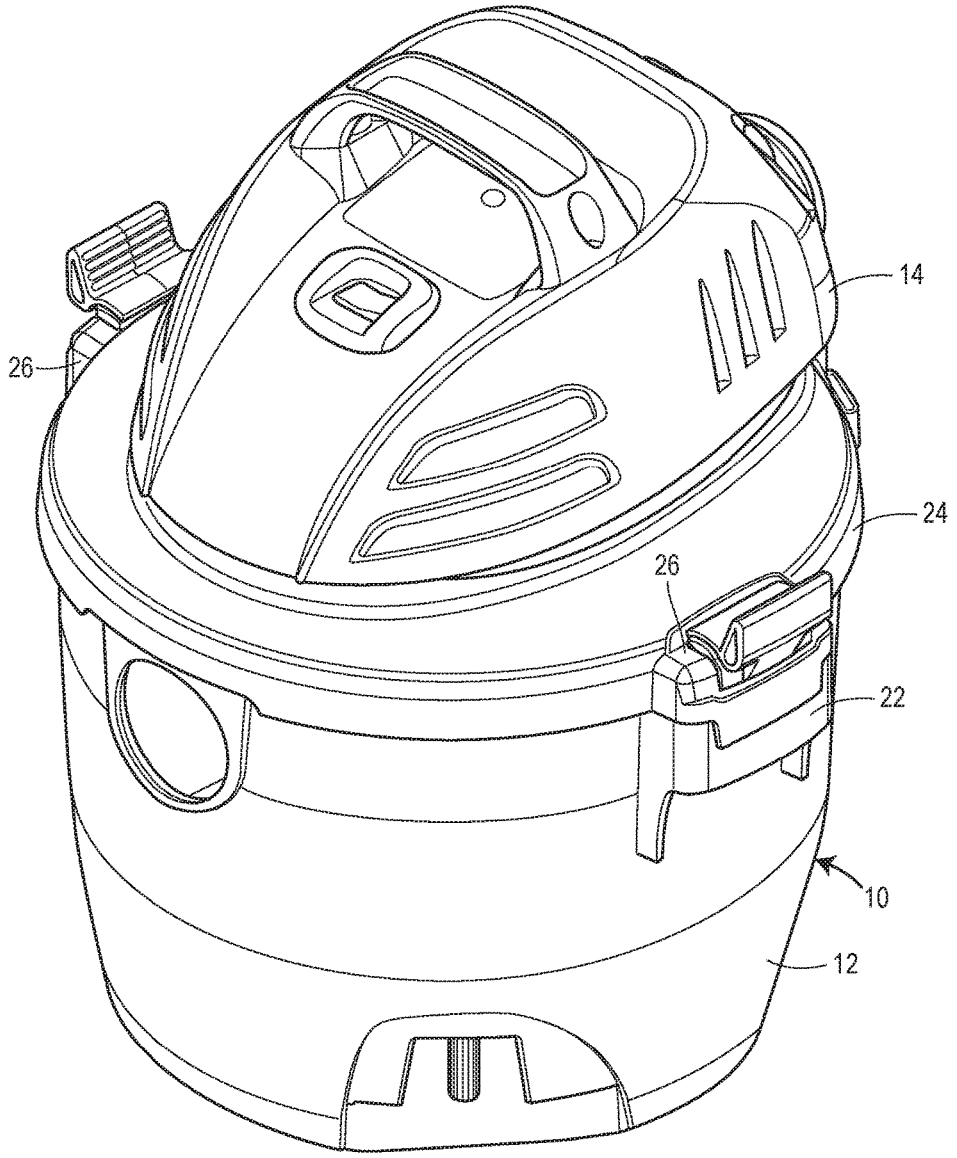
FIG. 1 is an isometric view of one embodiment of a wet/dry vacuum cleaner that uses the invention.
Figure 2:
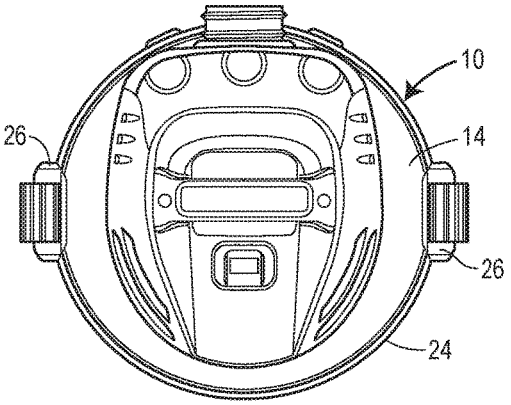
FIGS. 2-4 are top plan, front elevation, and side elevation views of the wet/dry vacuum cleaner.

The new vacuum cleaner latch arrangement is illustrated on the vacuum cleaner 10 seen in FIGS. 1-4. In the context of the present invention, the four important parts of that vacuum cleaner are a tank 12, a removable lid 14, a stationary part 16 or 16'(FIGS. 5-7 and 15-17), and a latch 18 or 18' (FIGS. 8-10 and 18-20). Each part will be discussed in turn.

The Tank 12

In general, the tank of a vacuum cleaner (best seen in FIGS. 1, 3, and 4) provides a reservoir in which dirt and debris collected by the vacuum cleaner are stored. Although not critical to this invention, the illustrated tank 12 may serve as such a reservoir.

The illustrated tank 12 is a conventional one. It is made of molded plastic, has a round cross-section, and holds 1-20 gallons of liquid or an equivalent volume of dirt and debris. Metal tanks can also be used. A bead 20 (seen in FIGS. 11 and 12) extends outwardly from an open upper end of the illustrated tank. The illustrated bead extends around the entire periphery of the tank and projects outwardly from the rest of the tank. In other examples, the bead may extend around only parts of the tank, and may take other forms, such as a top edge of a groove in the tank wall.

The tank 12 may have wheels or casters, as known in the art.

Figure 3:
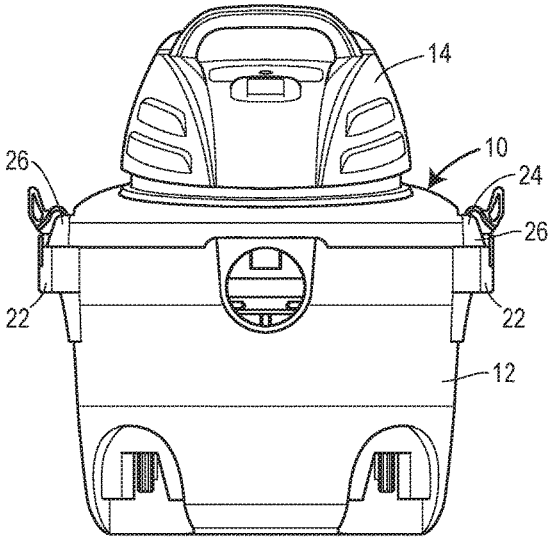
Figure 4:
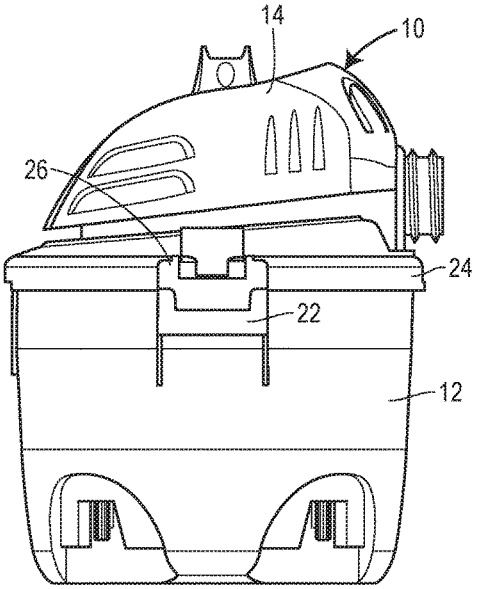

As best seen in FIGS. 1, 3, and 4, the illustrated tank 12 has a pair of opposed latch lower bases 22, which, in the prior art, serve as bases for prior art latches.

The Removable Lid 14

The removable lid 14 (best seen in FIGS. 1-4) closes the open upper end of the tank 12, preventing the contents of the reservoir from being spilled. Often, the removable lid of a vacuum cleaner houses the impeller and motor of the vacuum cleaner that serve as the vacuum source for the vacuum cleaner 10. Although not critical to this invention, the illustrated lid 14 may also house such a vacuum source.

The illustrated removable lid 14 is also a conventional one. It is also made of molded plastic, and has a skirt 24 that covers the bead 20 on the tank 12 when the lid is fitted on the tank. In other arrangements, the lid may cover only part of the bead.

The illustrated lid 14 has a pair of opposed latch upper bases 26 that extend outwardly away from the skirt 24. When placing the lid on the tank 12, the latch upper bases are aligned with the latch lower bases 22.

The latch upper bases 26 have openings that are bounded by outer peripheral surfaces on the lid 14. In the prior art (seen in FIGS. 11 and 12), these openings would be used for mounting part of a prior art latch. The illustrated openings are bordered by a retaining edge 30 and by a bottom edge 32. In many cases, it will be preferable for these edges to be parallel.

Figure 11:
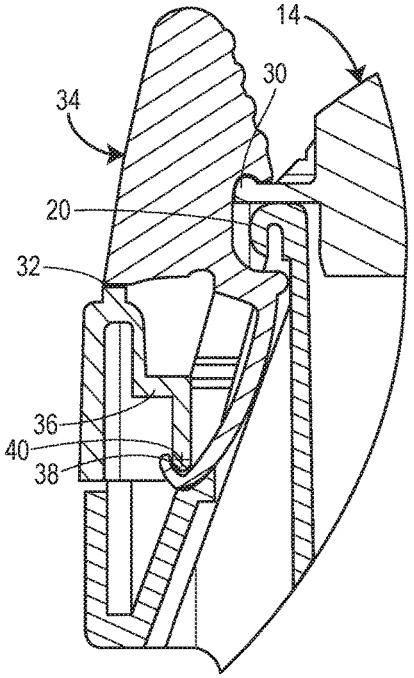
FIG. 11 PRIOR ART
FIGS. 11 and 12 are cross-sectional views of a prior art latch arrangement used on the same tank and lid, showing the latched and unlatched positions.
Figure 12:
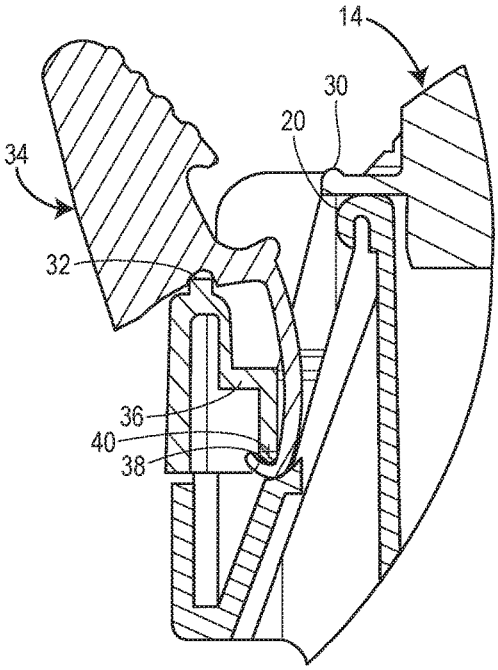
FIG. 12 PRIOR ART

As seen in FIGS. 11 and 12, a prior art latch 34 hooks onto the retaining edge 30 to hold the lid in place. However, a latch hooked onto such a retaining edge might sometimes be become inadvertently unlatched.

Each of the illustrated openings has a seat 36 that extends downwardly and inwardly from the bottom edge 32. The seat is configured to flex inwardly or outwardly with respect to the rest of the lid. Other shapes and configurations have been and could be used, but the shape and configuration of the opening (and its associated seat) will affect shape and configuration of the stationary part 16 used with such a vacuum cleaner.

In the present invention, a lower edge 38 of the seat 36 is utilized as a pivot axis 40. This will be explained in more detail in the description of the latch 18.

The Stationary Part 16

Figure 5:
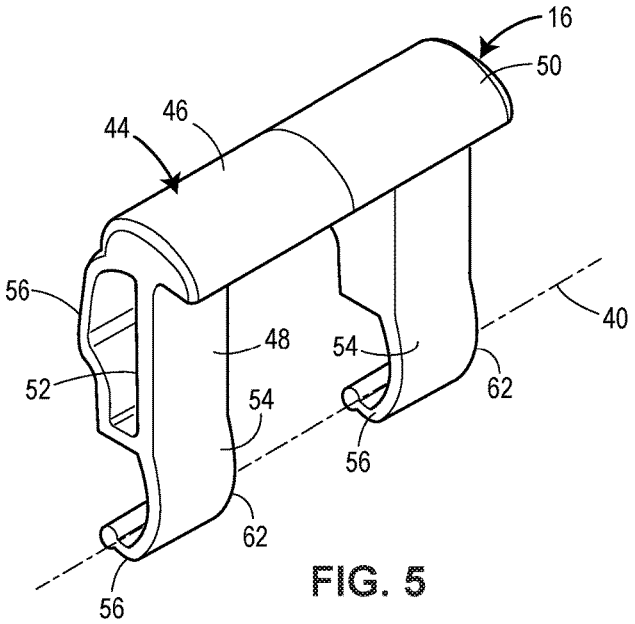
FIGS. 5-7 are enlarged isometric, front elevation, and side elevation views of a stationary part used in the wet/dry vacuum cleaner.
Figure 6:
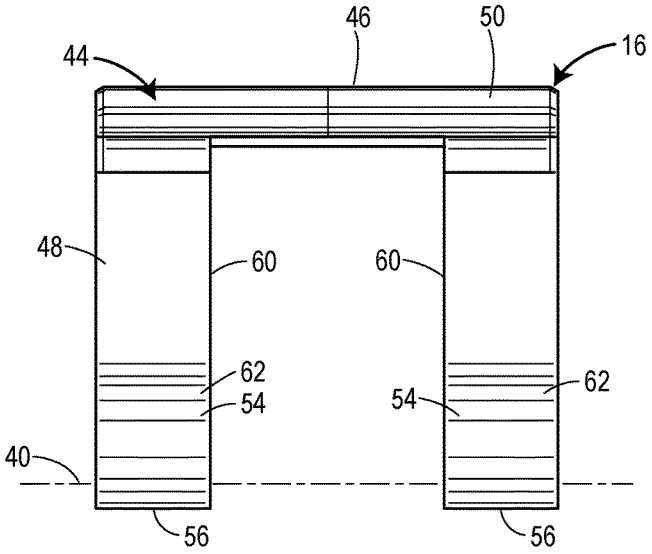
Figure 7:
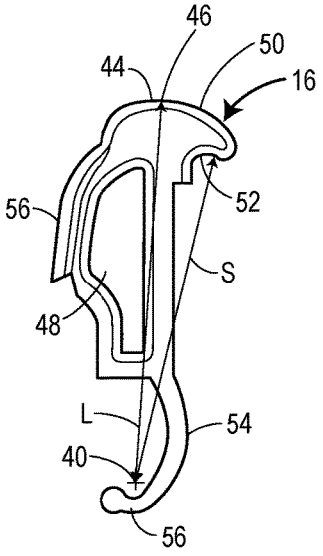
Figure 8:
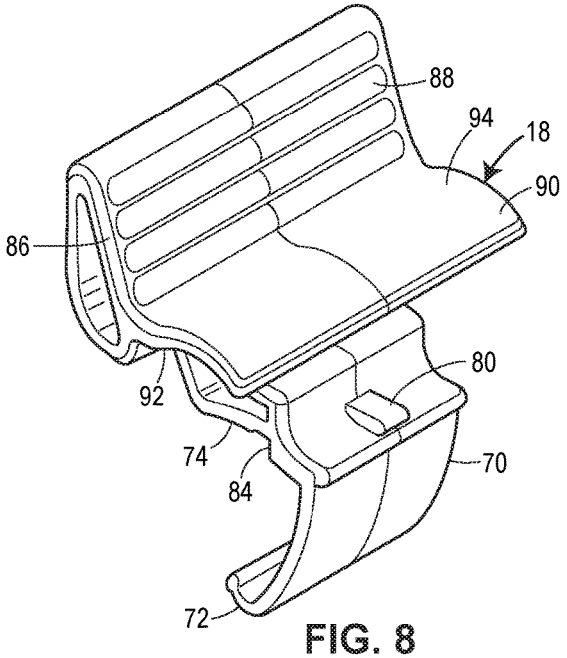
FIGS. 8-10 are enlarged isometric, front elevation, and side elevation views of a latch used in the wet/dry vacuum cleaner.
Figure 9:
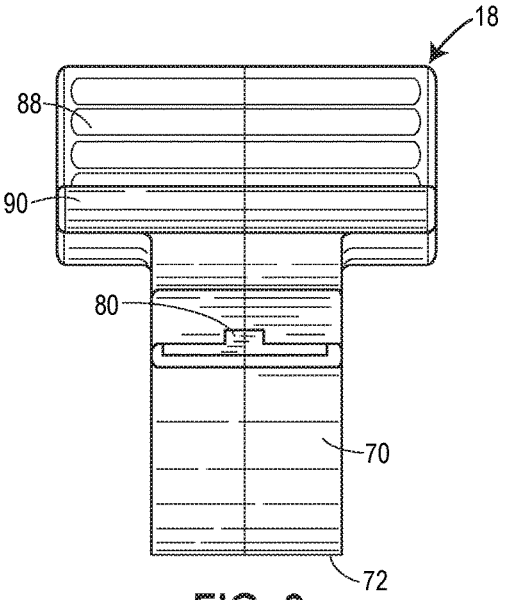
Figure 10:
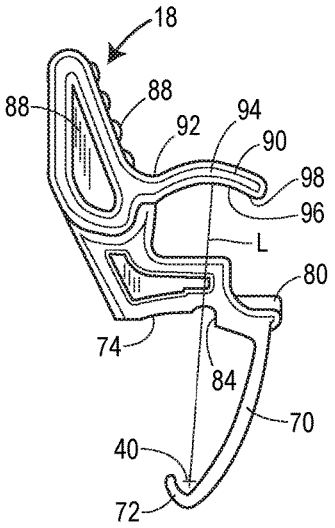
Figure 13:
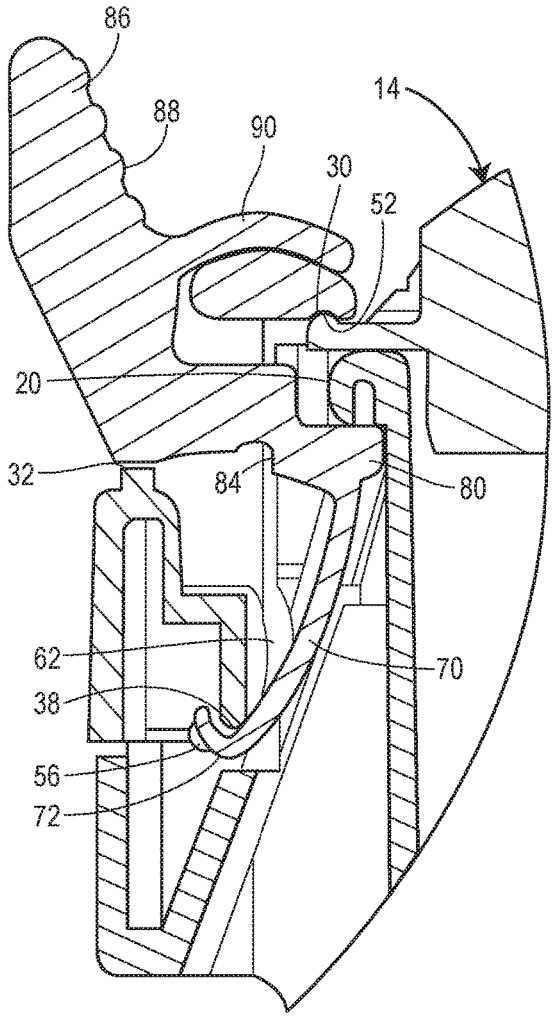
FIGS. 13 and 14 are cross-sectional views of the new latch arrangement, showing the latched and unlatched positions.
Figure 14:
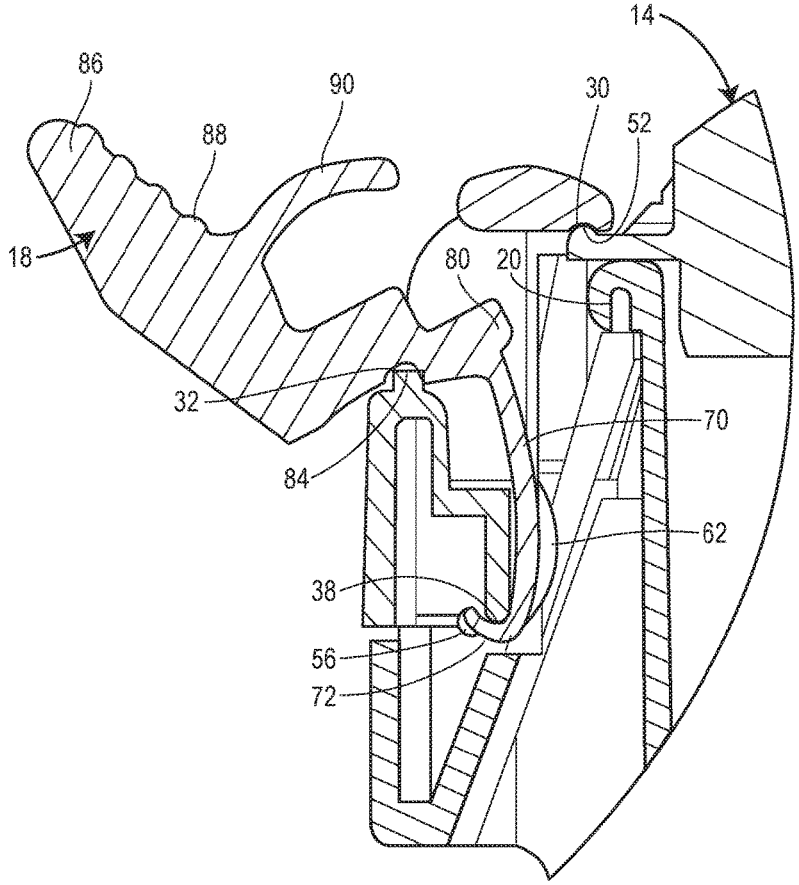
Figure 15:
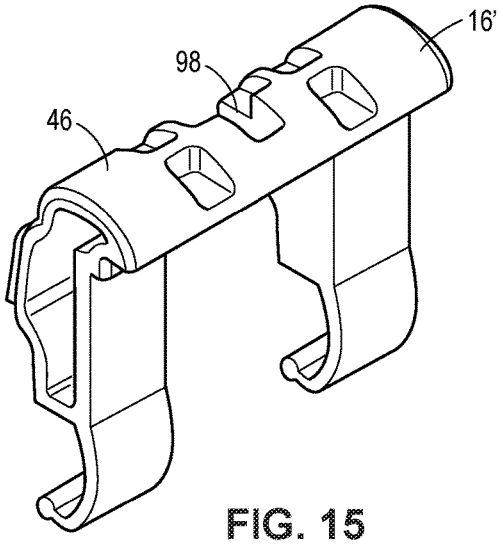
FIGS. 15-20 are views corresponding to FIGS. 5-10 of a second embodiment of a stationary part and latch that can be used in the illustrated vacuum cleaner.
Figure 16:
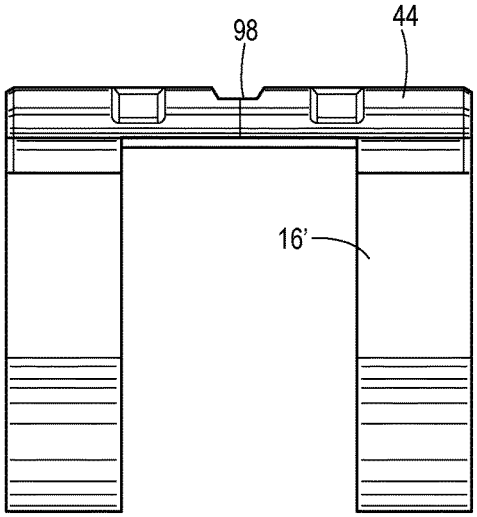
Figure 17:
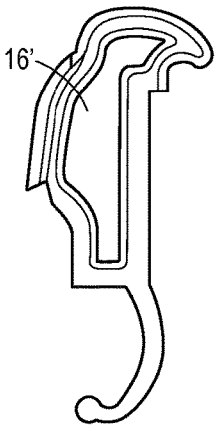
Figure 18:
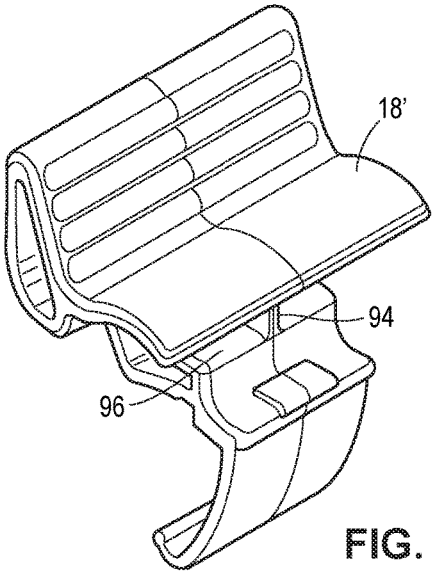
Figure 19:
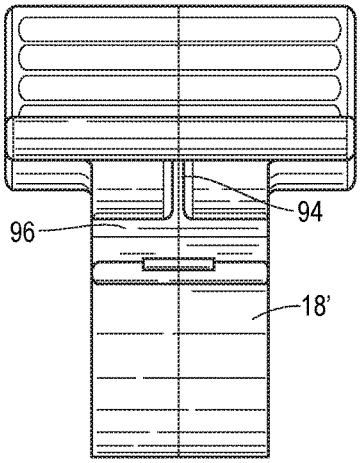
Figure 20:
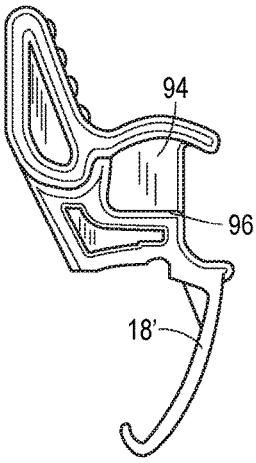

Best seen in FIGS. 5-7, the stationary part 16 is one of two new pieces used in the present invention, and provides a latching surface 44 that provides more security for locking a latch in place than the prior art retaining edge 30 on the lid 14. The illustrated latching surface has an extended portion 46 that, when the stationary part is clipped in place on the lid (as seen in FIGS. 13 and 14), is spaced at locking distance L from the pivot axis 40. The latching surface also has a latching portion 50 that is positioned distally of the extended portion, and, at its terminal end, is spaced at a distance S from the pivot axis that is shorter than the locking distance L. The functionality of the latching surface will be discussed in more detail when the latch is described in detail.

The stationary part 16 clips in place in one of the openings on the latch upper bases 26 on the lid 14, and is not intended to be removable by the consumer after purchase. For use with the illustrated prior art lid 14, the new stationary part is an integrally molded plastic piece.

The main body 48 of the stationary part 16 is narrower than the distance between the retaining edge 30 on the lid 14 and the bottom edge 32. This enables one side of the stationary part to be passed through the opening in the lid during assembly.

On one side, the stationary part 16 has a retaining surface 52 (best seen in FIGS. 7, 13, and 14) that mates with the retaining edge 30 of the lid 14. The illustrated retaining surface is a concave surface that has the same radius as the retaining edge. Variations are possible.

Unlike the prior art latch 34, the new stationary part 16 has a distally extending flange 56 that fits against the seat 36 on the lid 14 and inhibits the stationary part from being moved distally with respect to the retaining edge 30.

The stationary part 16 has a resilient hooked arm 54 that extends downwardly and has an outward hook 56 at its lower end. Like the hooked end of the prior art latch 34, this hook hooks onto the lower edge 38 of the seat 36 on the lid 14. Unlike the prior art latch, the illustrated hooked arm is a split one, with a gap 60 existing between two arm segments 62.

Once the retaining surface 52 on the stationary part 16 is positioned on the retaining edge 30 on the lid 14, the stationary part can be secured in place by pressing the hooked arm 54 against lower portions of the seat 36 on the lid, causing the seat and/or the hooked arm to deflect until the stationary hook 56 clips over and secures onto the lower edge 38 of the seat. In that position, interaction between the retaining surface and the retaining edge prevent the stationary part from moving downwardly with respect to the lid, and interaction between the hook and the lower edge of the seat inhibit the stationary part from being lifted upwardly from the lid. Interaction between the flange 56 and the seat limits lateral movement of the stationary part within the opening. Thus, the stationary part is effectively locked in place on the lid. This arrangement enables the stationary part to be clipped in place on the lid without the use of other fasteners.

In addition to providing a new latching surface, using a stationary part like the illustrated one provides other benefits. First, it enables the latch to work with a conventional lid. This provides a manufacturer with increased flexibility in the type of latch that can be used on its vacuum cleaners, and saves the costs of molding and/or stocking a second lid. Second, using a stationary part like this enables the lid and the stationary part to be made of different materials. The use of different materials enables the manufacturer to use a less expensive material for one part or the other, and/or, for product aesthetics, to use different colors without the need for painting, etc.

The Latch 18

The latch 18 (best seen in FIGS. 8-10), serves to provide a selectable and latchable connection between the lid 14 and the tank 12, preventing the lid from being removed from the tank.

The latch 18 fits into the same opening where the stationary part 16 is mounted. The latch has a latch arm 70 that fits into the gap 60 between the arm segments 62 on the stationary part. (Alternatively, it might be possible in some cases for latch to have arms that straddle a single arm on the stationary part.) A pivoting hook 72 at the end of the latch arm fits over the lower edge 38 of the seat 36 on the lid, permitting the latch to rotate about the pivot axis 40 but preventing the latch from being lifted from the opening. A bottom face 74 of the latch fits against the bottom edge 32 of the opening, preventing the latch from moving downwardly and thus holding the pivoting hook in position against the lower edge of the seat.

When the lid 14 is mounted on the tank 12, the latch 18 is free to pivot about the pivot axis 40 between a latched position seen in FIG. 13 and an unlatched position seen in FIG. 14. In the latched position, a latching part 80 of the latch fits under the bead 20 on the tank 12, inhibiting the lid from being lifted from the tank. Other arrangements for inhibiting the lid from being removed could be used. For example, the bead could be provided with a slot and the latching part could slide into the slot. Alternatively, the latching part might press or otherwise move another part into a locking position. The illustrated arrangement is advantageous because it has only one moving part.

In the unlatched position (FIG. 14), the latching part 80 pivots out from under the bead 20 to a different position, removing the impediment to the lid 14 being lifted from the tank 12. Interference between a stop 84 on the latch 18 and the bottom edge 32 of the opening on the lid limits the outward range of travel of the latch as it pivots about the pivot axis 40.

A tab 86 on the latch 18 provides a user with a convenient means for moving the latch between the latched position and the unlatched position. A tab surface 88 on the tab is positioned where it can be engaged by a user to push the latch outwardly as it pivots from the latched position to the unlatched position.

To enable a user to lock the latch 18 in the latched position, the illustrated latch 18 has a deflectable arm 90 that is an integrally formed part of the latch. The deflectable arm extends from a base end 92 at a distal end of the tab surface 88, and is longer than it is thick. In the illustrated latch, a central portion 94 of an engagement surface 96 on the lower surface of the deflectable arm is positioned at or slightly beyond the locking distance L from the pivot axis 40. A terminal portion 98 of the deflectable arm is positioned closer to the pivot axis. The illustrated deflectable arm curves from the central portion to the terminal portion (at a radius that is shorter than the distance L), but this need not always be the case. For example, a straight edge might be used. In general, it may be preferred for the configuration of the engagement surface on the deflectable arm to match the configuration of the latching surface 44 on the stationary part 16.

To enable the deflectable arm 90 to deflect sufficiently, the central portion 94 of the illustrated deflectable arm 90 is preferably no more than four times thicker than the difference between the locking distance L and the shorter distance S from the pivot axis 40 to the latching portion 50 of the latching surface 44 on the stationary part 16. This relative slenderness helps to provide flexibility to the deflectable arm. Other ways to provide flexibility are possible. For example, use of a more flexible material or of a joint with a biasing mechanism such as a spring could be used. The illustrated arrangement, however, is simpler.

As the latch 18 pivots about the pivot axis 40 from the unlatched position toward the latched position, a terminal side of the deflectable arm 90 comes into contact with the latching surface 44 on the stationary part 16. The flexibility of the deflectable arm enables that arm to deflect upwardly far enough so that the terminal portion 98 of the arm can pass over the extended portion 46 of the latching surface. Subsequent pivoting of the latch moves the terminal portion 98 of the deflectable arm over the latching portion 50 on the stationary part as the deflectable arm returns toward its undeflected position, with the central portion 94 of the engagement surface 96 ultimately aligning with the extended portion 46 of the latching surface. In this position, engagement of the terminal portion of the engagement surface with the latching portion of the latching surface helps to inhibit the latch from pivoting back toward the unlatched position, thus helping to hold the latch in the latched position.

FIGS. 15-20 show an alternative stationary part 16' and latch 18' that provide a tighter fit between parts of the deflectable arm 90 and the latching surface 44. These parts include a rib 94 that connects those parts of the deflectable arm to a base 96 of the latch 18'. In general, the wider the deflectable arm, the more useful such a rib may be. A corresponding slot 98 in the latching surface 44 of the stationary part 16' accommodates the rib when the latch is moved to the latched position.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that has:

a tank that has an open upper end;

a removable lid that fits on the tank and closes the open upper end of the tank;

a latching surface that is on a part that is made separately from the lid, and is held on the lid by a hooked end that fits over an edge on the lid and by a stationary retaining surface that engages a retaining edge on the lid;

a latch that, when the lid is on the tank, pivots about a pivot axis between a latched position in which a latching part inhibits the lid from being lifted from the tank, and an unlatched position in which the latching part is moved to a different position and does not inhibit the lid being lifted from the tank;

an engagement surface that is on the latch, pivots about the pivot axis, and fits over the latching surface when the latch is in the latched position; and a tab that is positioned where it can be engaged by a user to push the latch from the latched position to the unlatched position.

2. A vacuum cleaner as recited in claim 1, in which:

the engagement surface is on a deflectable arm that is longer than it is thick.

3. A vacuum cleaner as recited in claim 1, in which:

the tab has a tab surface that is positioned where it can be engaged by a user to push the latch outwardly from the latched position to the unlatched position; and the engagement surface is on a deflectable arm that has a base end that is positioned at a proximal end of the tab surface.

4. A vacuum cleaner as recited in claim 1, in which:

the deflectable arm is an integrally formed part of the latch.

5. A vacuum cleaner that has:

a tank that has an open upper end;

a removable lid that fits on the tank and closes the open upper end of the tank;

a latching surface that is on a part that is made separately from the lid, and is held on the lid by a hooked end that fits over a pivot edge on the lid and by a stationary retaining surface that engages a retaining edge on the lid;

a latch that has a hooked latch end that fits over the pivot edge and, when the lid is on the tank, pivots about the pivot axis between a latched position in which a latching part of the latch inhibits the lid from being lifted from the tank, and an unlatched position in which the latching part is moved to a different position and does not inhibit the lid being lifted from the tank;

an engagement surface that is on the latch, pivots about the pivot axis, and fits over the latching surface when the latch is in the latched position, holding the latch in the latched position; and a tab that is positioned where it can be engaged by a user to push the latch from the latched position to the unlatched position.

6. A vacuum cleaner as recited in claim 5, in which:

the tab has a tab surface that is positioned where it can be engaged by a user to push the latch outwardly from the latched position to the unlatched position; and the engagement surface is on a deflectable arm that has a base end that is positioned at a proximal end of the tab surface.

7. A vacuum cleaner as recited in claim 6, in which:

the deflectable arm is an integrally formed part of the latch.

8. A vacuum cleaner that has:

a tank that has an open upper end;

a removable lid that fits on the tank and closes the open upper end of the tank;

a part that is made separately from the lid, is held on the lid by a hooked end that fits over an edge on the lid and by a stationary retaining surface that engages a retaining edge on the lid, and has a latching surface with a slot;

a latch that has a deflectable arm and, when the lid is on the tank, pivots about a pivot axis between a latched position in which a latching part inhibits the lid from being lifted from the tank, and an unlatched position in which the latching part is moved to a different position and does not inhibit the lid being lifted from the tank;

an engagement surface that is on the deflectable arm, pivots about the pivot axis, and fits over the latching surface when the latch is in the latched position:

a tab that is positioned where it can be engaged by a user to push the latch from the latched position to the unlatched position;

a rib that connects a distal part of the deflectable arm to a base on the latch and moves within the slot when the latch is moves to the latched position.

* * * * *